US005966900A

United States Patent [19]

Burford et al.

[11] Patent Number: 5,966,900

[45] Date of Patent: Oct. 19, 1999

[54] VERTICAL BAGGER

[75] Inventors: Charles E. Burford, Athens, Tex.; Jerry Dale Pack, Pauls Valley, Okla.

[73] Assignee: Burford Corp., Maysville, Okla.

[21] Appl. No.: 08/749,490

[22] Filed: Nov. 15, 1996

[51] Int. Cl.[6] ..... B65B 43/38

[52] U.S. Cl. ..... 53/384.1; 53/385.1; 53/570; 53/583; 53/138.7

[58] Field of Search ..... 53/385.1, 138.6, 53/138.8, 583, 384.1, 570, 492, 468, 469, 138.7

[56] References Cited

U.S. PATENT DOCUMENTS

| | | | |
|---|---|---|---|
| 3,261,143 | 7/1966 | Platt et al. | 53/138.8 |
| 3,495,378 | 2/1970 | Kipers | 53/385.1 |
| 3,990,216 | 11/1976 | Martin | 53/138.8 |
| 4,172,349 | 10/1979 | Lipes | 53/385.1 |
| 4,291,517 | 9/1981 | Lipes | 53/583 |
| 4,368,608 | 1/1983 | Ray | 53/385.1 |
| 4,554,776 | 11/1985 | Chikatani | 53/583 |
| 4,999,969 | 3/1991 | Holmes | 53/138.3 |
| 5,442,898 | 8/1995 | Gabree et al. | 53/385.1 |
| 5,692,358 | 12/1997 | Frazier et al. | 53/138.8 |

OTHER PUBLICATIONS

"Burford vertical bagger/tyer" (models Jul. 1, 1971, Jul. 2, 1972) advertisement with specifications.

*Primary Examiner*—James F. Coan
*Assistant Examiner*—Gene L. Kim
*Attorney, Agent, or Firm*—Crutsinger & Booth

[57] ABSTRACT

An automated bagging system fills and closes a bag by delivering an air jet to open the bag. A pair of horns engage the inner surfaces of the bag wherein the bag is subsequently filled. A bag transfer mechanism engages the outer surface of the bag with pinch belts and the pinch belts transfer the bags to a bag closing apparatus to close the filled bag.

17 Claims, 11 Drawing Sheets

VERTICAL BAGGER

TECHNICAL FIELD

Apparatus for filling a bag and transferring the filled bag to a bag tying apparatus is disclosed.

BACKGROUND OF INVENTION

For filling and tying bags of certain products, such as tortillas, the bags are generally filled manually and moved by a worker to a bag closing apparatus. Tortillas and similar items are generally stacked one on top of the other to form a generally cylindrical stack of a predetermined number of tortillas. The stack is then deposited in a bag and the bag closed for shipment.

Further, filling bags with granular material or several small items generally requires that the bag be held in an upright position while it is being filled and transported until the open neck of the bag has been closed.

A need exists for a bagger that can open and hold a bag while it is being filled and associated apparatus for removing the filled bag from the bagger, closing the bag and depositing the closed bag on a suitable conveyor to be deposited in boxes or other containers for shipment.

SUMMARY OF INVENTION

Bagging apparatus, bag transfer apparatus and a tyer are mounted on a common frame. An air jet is delivered into a bag supported by one edge on a wicket. After air has been delivered to open the bag, a pair of horns rotate about horizontal axes to move into and engage the upper end of the bag. A pressure switch is positioned to indicate whether or not the horns have properly engaged the upper end of the bag for filling. After the bag has been filled, a bag transfer mechanism moves to a position adjacent the horns for gripping the neck of the bag for removal from the bagger and for transporting the bag to a bag tying mechanism. The bag tying mechanism wraps a twist-tie around the neck of the bag and deposits the closed bag on a conveyor.

DESCRIPTION OF THE DRAWINGS

Drawings of a preferred embodiment of the invention are annexed hereto, so that the invention may be better and more fully understood, in which.

Numeral references are employed to designate like parts throughout the various figures of the drawing.

DESCRIPTION OF A PREFERRED EMBODIMENT

Figure 1:
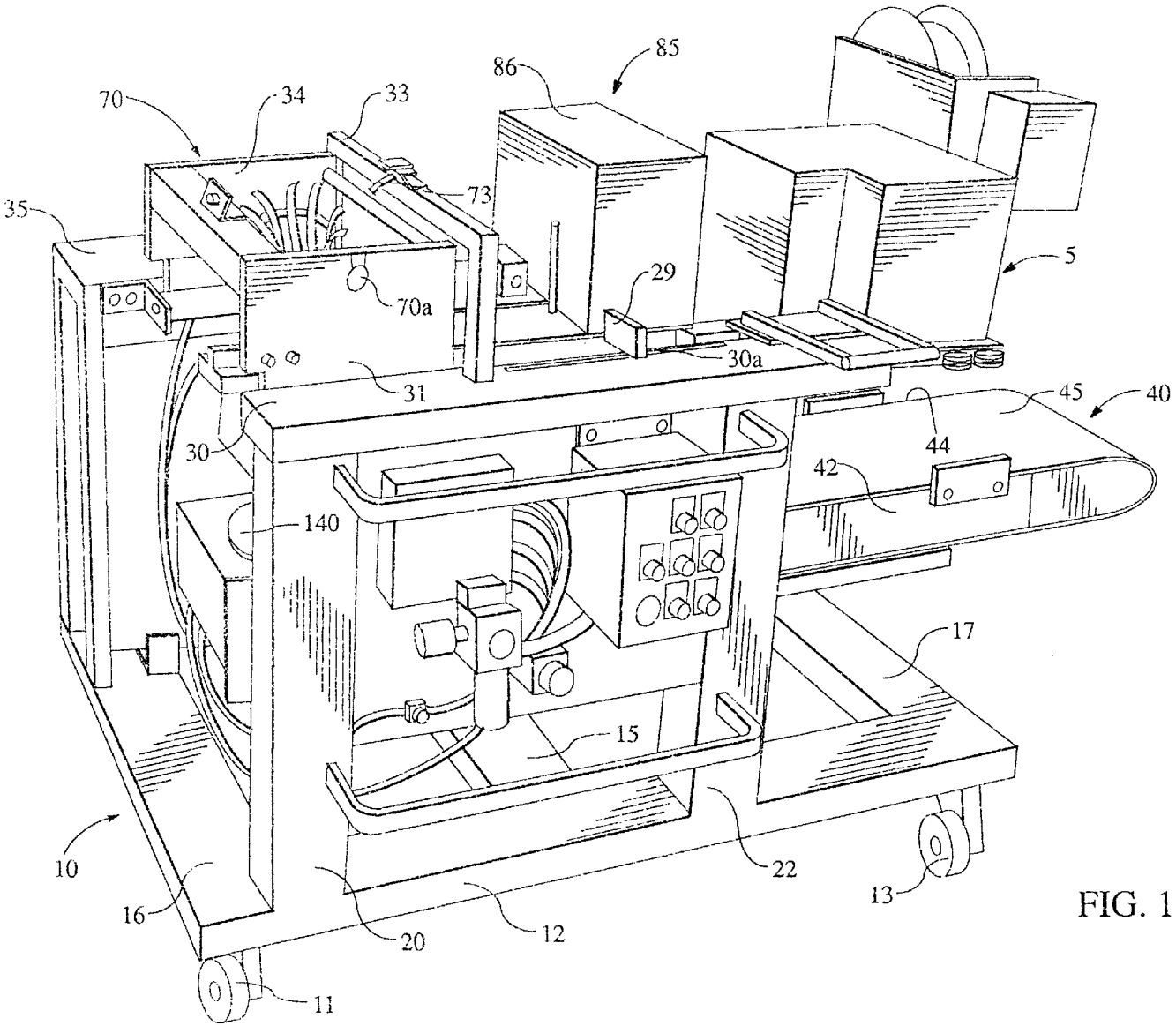
FIG. 1 is a perspective view illustrating the front and bagger end of the apparatus.
Figure 2:
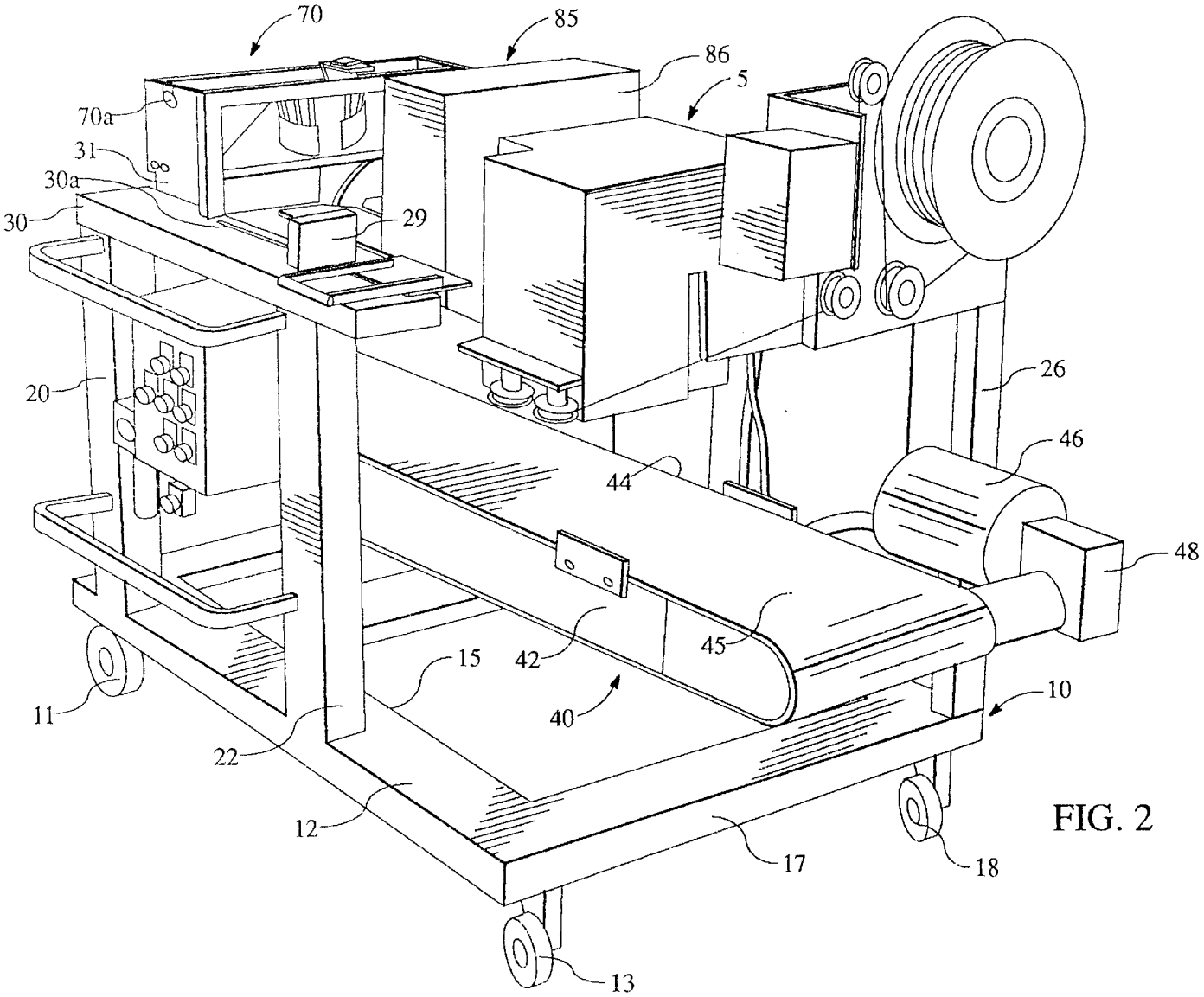
FIG. 2 is a perspective view illustrating the front and tyer end.

Referring to FIGS. 1 and 2 of the drawings, the numeral 10 generally designates a frame having a base portion formed by longitudinally extending members 12 and 14 joined by a plurality of transversely extending base frame members 15, 16 and 17. In the illustrated embodiment, transverse members 16 and 17 are welded or otherwise secured to opposite ends of longitudinally extending members 12 and 14. Opposite ends of transverse member 15 are welded or otherwise secured to the central portions of longitudinally extending members 12 and 14. The base portion of frame 10 is supported by casters 11, 13, 17 and 19.

Figure 4:
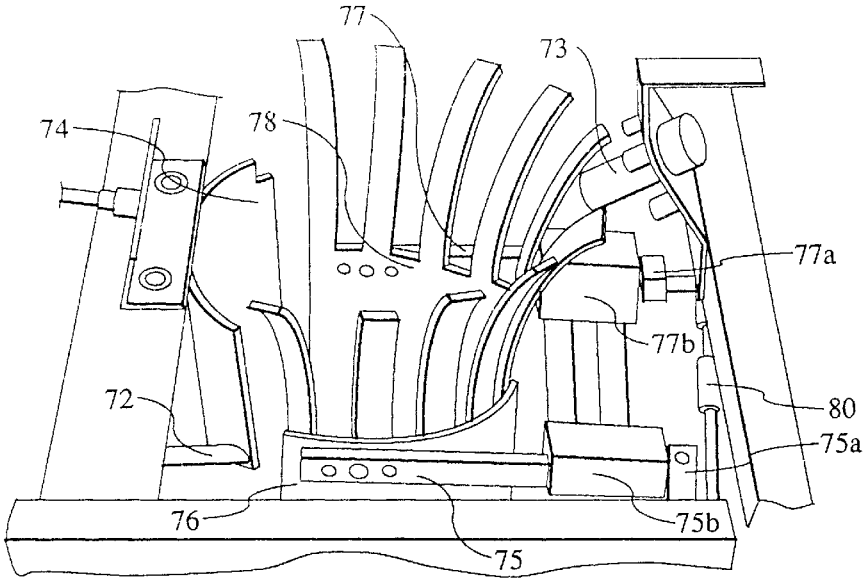
FIG. 4 is a perspective view illustrating the rear and tyer end.

As best illustrated in FIGS. 1 and 4 of the drawing, hollow posts 20 and 24 extend upwardly from longitudinal member 12 and, as illustrated in FIG. 4, hollow posts 24 and 26 extend upwardly from longitudinally extending member 14.

A longitudinally extending ledge 30 is secured to upper ends of posts 20 and 22 vertically above longitudinally extending member 12, as best illustrated in FIG. 1 of the drawing.

Referring to FIG. 4 of the drawing, a ledge member 35 is supported by upper ends of posts 24 and 26 and has an outer end supported by an end wall 32 that extends upwardly from the end of longitudinally extending member 14.

A conveyor assembly, generally designated by the numeral 40 in FIG. 2 of the drawing, is formed by a pair of side rails 42 and 44 having rollers extending therebetween. A conveyor belt 45 extends around the rollers. A variable speed electric motor 46 is secured to side rail 44 and drives one of the belt rollers through a gear box 48.

Conveyor assembly 40 is supported on a carriage assembly 50 that moves vertically along posts 24 and 26. As best illustrated in FIG. 4 of the drawing, carriage assembly 50 is formed by spaced plates 52 and 54 that extend along opposite sides of post 26. A plurality of rollers 55 are rotatably mounted between plates 52 and 54 and engage front and rear faces of post 26. A channel member 56 extends longitudinally of plates 52 and 54 and has spaced lugs 58 extending upwardly for supporting side rails 42 and 44 of conveyor assembly 40. A threaded nut is welded or otherwise secured to carriage assembly 50 between spaced plates 52 and 54. A threaded shaft 60 extends downwardly through the hollow interior of post 26 and through the threaded nut secured to carriage assembly 50.

A second carriage assembly 50*a*, substantially identical to carriage assembly 50, moves vertically along post 24. A threaded shaft 60*a* extends vertically through the hollow portion of post 24. Shafts 60 and 60*a* have sprockets mounted adjacent the upper ends thereof below ledge 35 and a chain extends around the sprockets. Shaft 60 has a hand wheel 65 mounted on the upper end thereof such that rotation of hand wheel 65 imparts rotation to shaft 60 which rotates the sprocket mounted thereon which imparts rotation through the chain to the sprocket mounted on shaft 60*a*. Thus, rotating hand wheel 65 causes threaded shafts 60 and 60*a* to rotate in unison for moving carriage assemblies 50 and 50*a* vertically along posts 24 and 26. Vertical movement of carriage assemblies 50 and 50*a* moves conveyor assembly 40 vertically relative to the frame 10 for accommodating bags of different heights and for positioning the bag in a predetermined location.

It should be readily apparent that carriage assemblies 50 and 50*a* form cantilever beams having supported ends vertically adjustable along posts 24 and 26 and that conveyor assembly 40 is mounted on the unsupported ends of the cantilever beams.

Referring to FIG. 1 of the drawing, the numeral 70 generally designates a bagger assembly supported between spaced mounting plates 31 and 34 secured to ledge members 30 and 35, respectively. An arch member 33 has downwardly extending legs that are supported by ledge members 30 and 35 and a cross bar extends across the upper ends of the legs to provide structural reinforcing for mounting plates 31 and 34 and for supporting bagger assembly 70.

Figure 5:
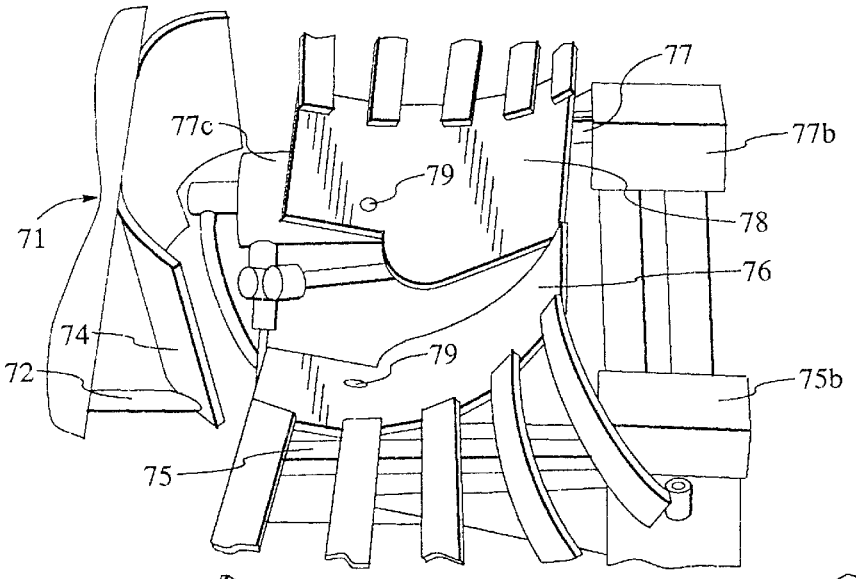
FIG. 5 is a perspective view of the horns of the bagger assembly positioned in a bag.

Referring to FIG. 5 of the drawing, a pair of pins 72 is mounted on a curved plate 74 to form a wicket to support a supply of bags. Bags to be filled are formed with a long side having an upper edge that extends above the upper edge of the shorter side of the bag. The long side of the bag has openings formed therein such that a stack of bags can be supported by the upper edge on one side and the short side of the bag terminates just below the lower edge of curved plate 74. The upper edge of the long side of the bag is notched just above a pair of holes that receive pins 72. As will be hereinafter more fully explained, when the bag has been filled, it will be pulled off of the pins 72 by a bag transfer mechanism 85.

An air nozzle 73 is mounted for delivering a blast of air against the surface of curved plate 74 such that the blast of air will be deflected downwardly into the bag hanging on wickets 72 for blowing the bag open.

Horns 76 and 78 are mounted on shafts 75 and 77 supported in spaced bearings 79*a* and 79*b*. Shafts 75 and 77 have cranks 75*a* and 77*a* formed on outer ends thereof and a link 80 is connected between cranks 75*a* and 77*a* for rotating shafts 75 and 77 in opposite directions for moving horns 76 and 78 from the position illustrated in FIG. 6 of the drawing to the position illustrated in FIG. 5 of the drawing.

Crank 75*a* has a crank arm that extends downwardly from shaft 75 while crank 77*a* extends upwardly from shaft 77. Link 80 extends from the upper end of crank 77*a* and to the lower end of crank 75*a*.

An air cylinder 77*c* having a piston rod is pivotally connected to crank 77*a*. When the piston rod is extended crank 77*a* and crank 75*a* rotate in unison in opposite directions.

Figure 6:
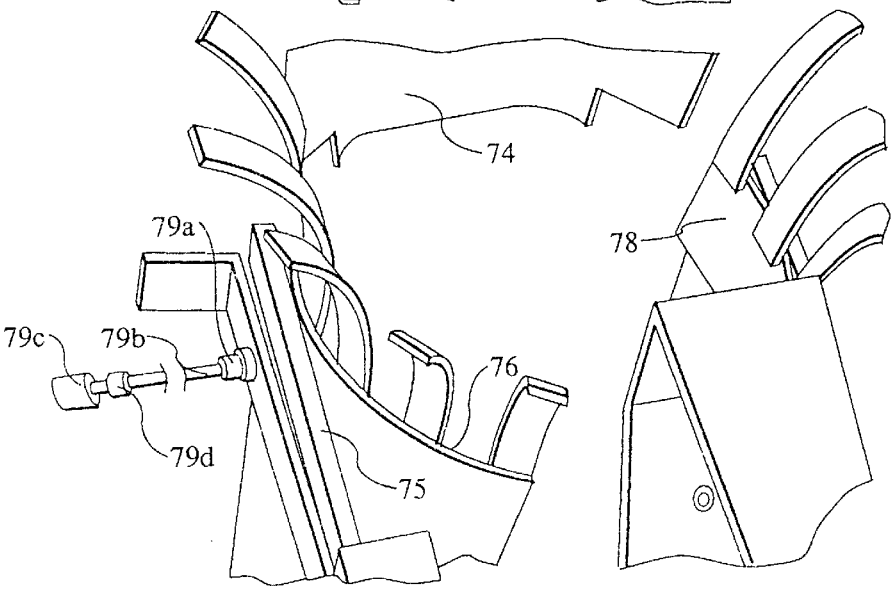
FIG. 6 is a perspective view of horns retracted from a bag.
Figure 8:
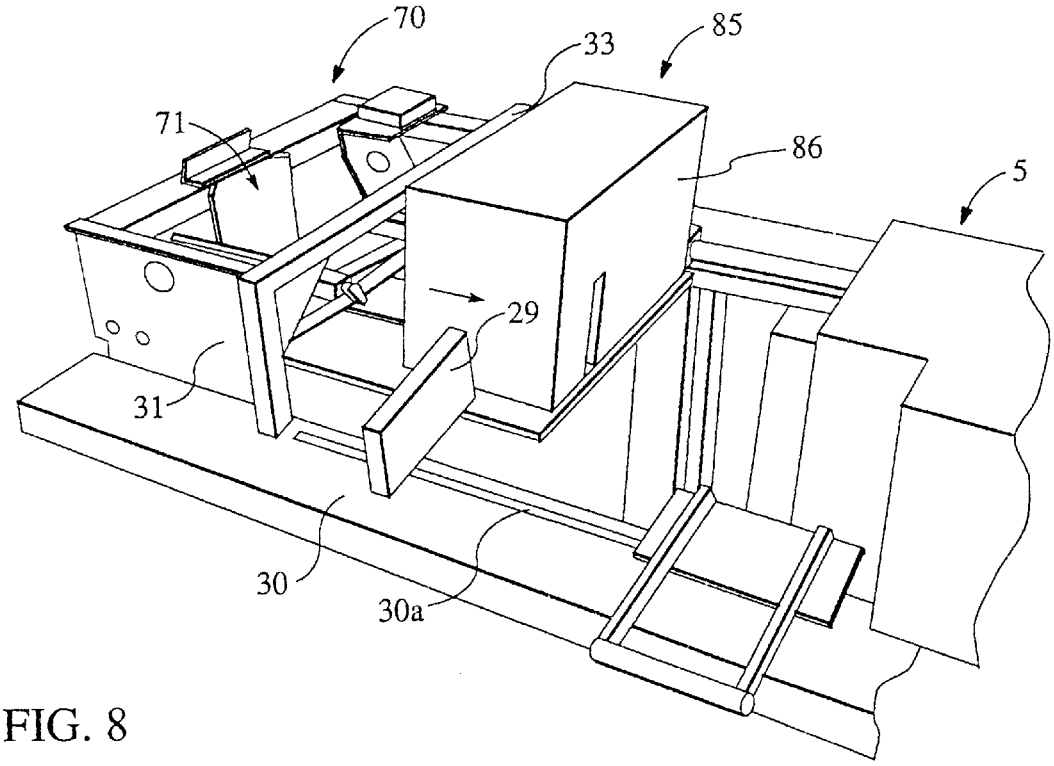
FIG. 8 is a perspective view of bag transfer apparatus in a home position.
Figure 7:
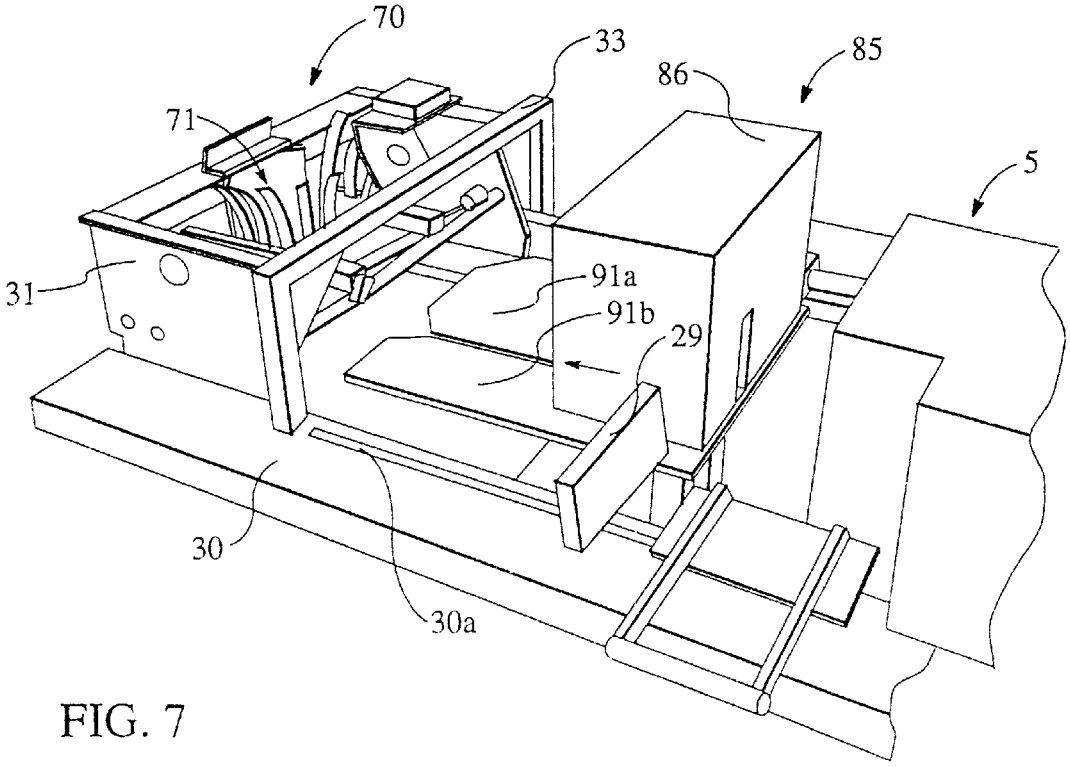
FIG. 7 is a perspective view of a valve and pressure switch associated with the horns of the bagging apparatus to indicate the presence of a bag.

As best illustrated in FIG. 6 of the drawing, each horn 76 and 78 has a passage 79 extending therethrough that moves to a position adjacent the end of an air valve 79*a* mounted on the frame. Valve 79*a* is connected through a hose 79*b* to a source of pressurized air. If horns 76 and 78 do not engage the open mouth of a bag hanging on wickets 72 adjacent the lower edge of curved plate 74, air is delivered through valve 79*a* and opening 79. However, if horns 76 and 78 move into the open end of a bag, the bag is moved across the rear face of horns 76 and 78 to close passages 79. As horns 76 and 78 move toward valve 79*a* air flow will be obstructed through valve 79*a* causing pressure to be built up in hose 79*b*. As will hereinafter be more fully explained, a pressure sensor in the control system actuates a valve to stop delivery of air to the air cylinder to stop reciprocation of horns 76 and 78.

It should be readily apparent that if a bag is not properly positioned on horns 76 and 78 for blocking flow through valve 79*a* air will be delivered sequentially to opposite ends of the air cylinder for causing horns 76 and 78 to reciprocate until they move into and engage the mouth of a bag hanging on wickets 72.

The air cylinder and horns 76 and 77 are mounted on a bagger frame that is removably mounted in the bagger assembly 70. Thus, different sizes and shapes of horns can be readily mounted in the bagger assembly 70 by merely rotating knobs 70*a* on screws extending through holes in mounting plates 31 and 34 extending into sides of the bagger frame, disconnecting air hoses and installing a different bagger assembly.

Figure 3:
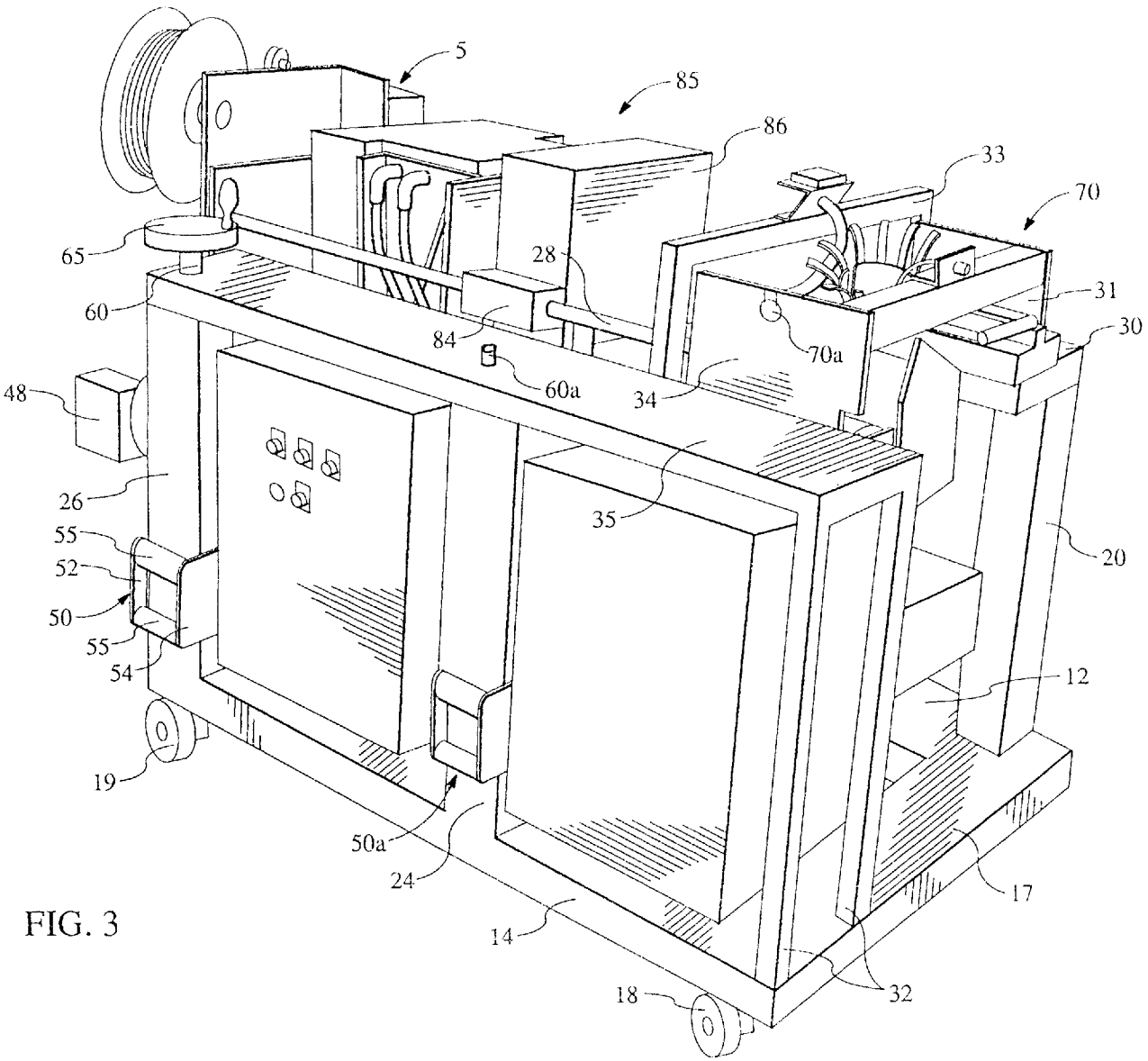
FIG. 3 is a perspective view illustrating the rear and bagger end.

As best illustrated in FIG. 3 of the drawing, a guide bar 28 extends generally parallel to ledge member 35 and has one end supported on arch member 33 and the opposite end supported on a bracket adjacent hand wheel 65, as will hereinafter be more fully explained.

Figure 9:
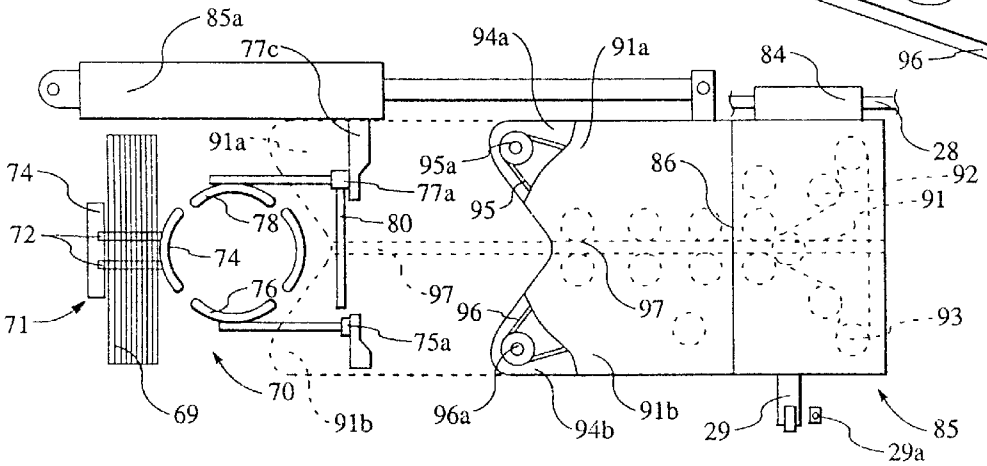
FIG. 9 is a diagrammatic plan view showing the relationship between the bag transfer mechanism and the bagger.

A bag transfer mechanism 85 is mounted in a housing having a sleeve 86 that is slidable along guide bar 28, as best illustrated in FIGS. 3, 4 and 9 of the drawing. The opposite side of the bag transfer mechanism 85 is supported by a guide arm 29 that moves along a groove formed in ledge member 30.

Bag transfer mechanism 85 comprises a housing having front and rear walls 86 and 87 and end walls 88 and 89. A variable speed DC motor 90*a* is mounted in the housing and has a drive shaft with a sprocket 91 for driving sprockets 92 and 93 on the upper ends of belt drive shafts 92*a* and 93*a* for rotating a pair of pinch belts 95 and 96 for gripping the neck of a bag between the pinch belts.

Figure 10:
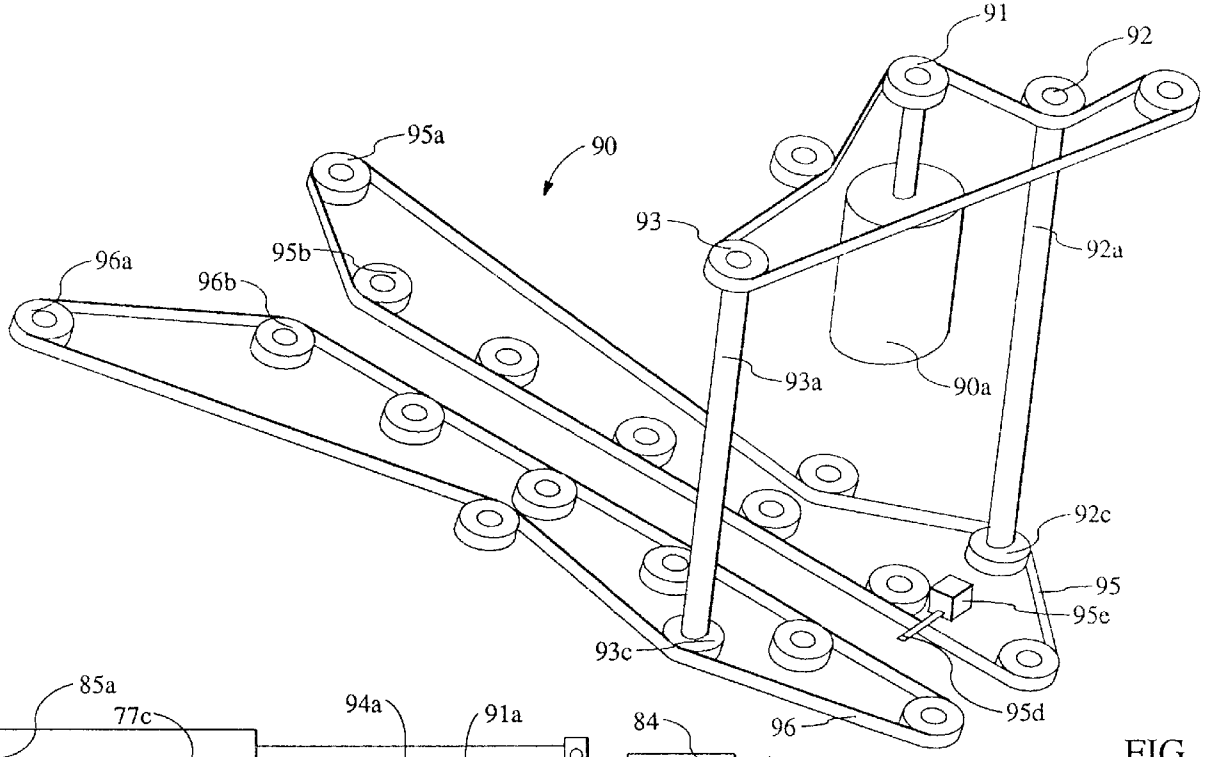
FIG. 10 is a diagrammatic perspective view illustrating the drive system of the bag transfer mechanism.
Figure 11:
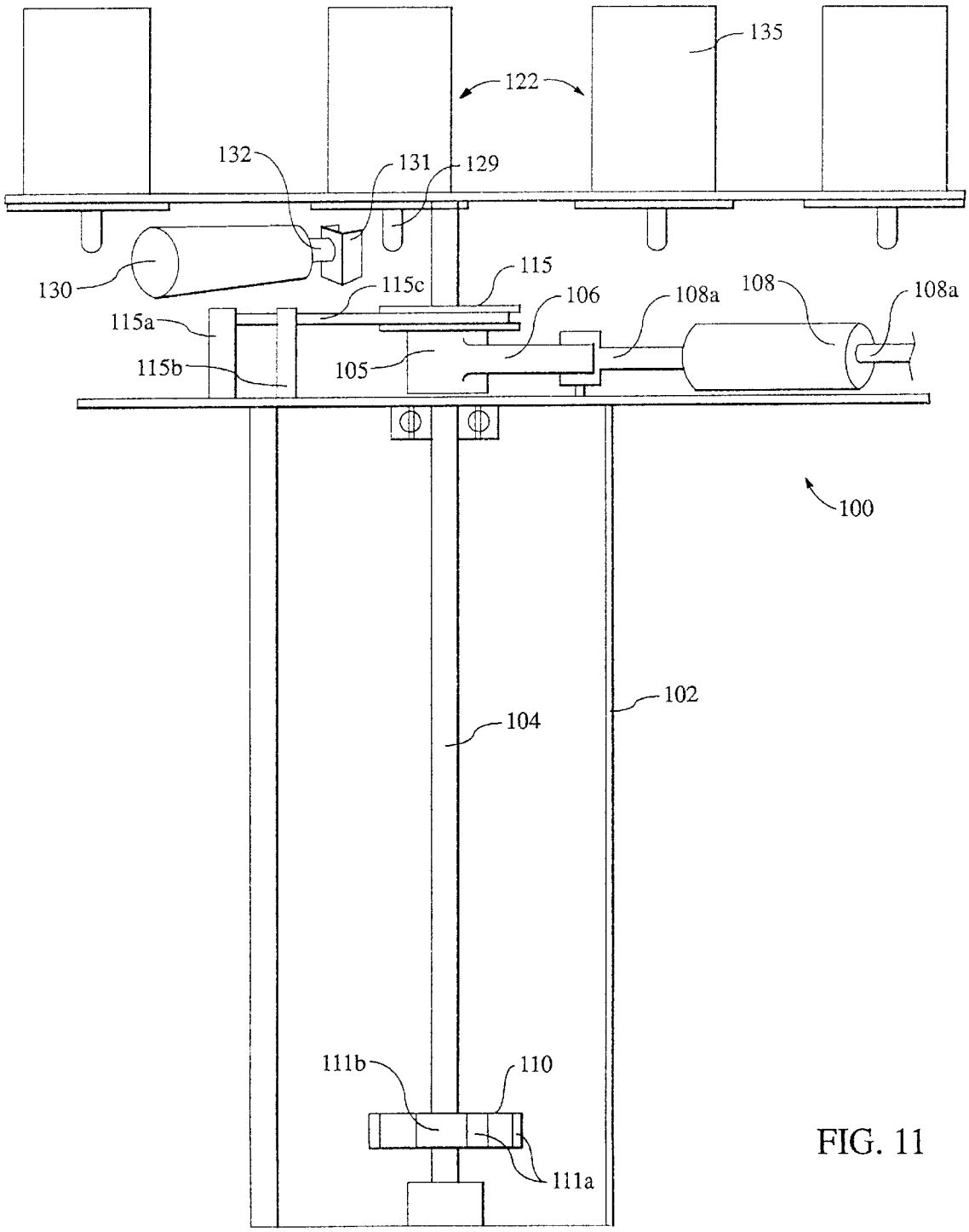
FIG. 11 is a fragmentary elevational view, parts being away to more clearly illustrate details of construction, showing the tortilla bag filling apparatus.

As best illustrated in FIGS. 10 and 11 of the drawing, the pinch belt assembly 90 is formed by a pair of upper plates 91*a* and 91*b* having a slot 96 extending generally longitudinally of the bag transfer mechanism. A pair of lower plates 93*a* and 93*b* are similarly positioned below upper plates 91*a* and 91*b* with a slot therebetween.

As best illustrated in FIG. 10, a plurality of pulleys is mounted between plates 91*a* and 93*a* and between plates 91*b* and 93*b*. Each pinch belt 95 and 96 extends around a drive pulley 92*c* or 93*c*, a tension adjustment pulley and a series of idler pulleys. Idler pulleys 95*a* and 96*a* are positioned relative to idler pulleys 95*b* and 96*b* for forming a generally V-shaped entrance into the area between pinch belts 95 and 96.

Referring to FIG. 9 of the drawing, when the piston in air cylinder 85*a* is retracted, bag transfer mechanism 85 will move from the full outline position in FIG. 9 to the dashed outline position adjacent bagger 70. Idler rollers 95*a* and 96*a* will be positioned adjacent horns 98 and 96, respectively such that pinch belts 95 and 96 engage the bags 40 on horns 76 and 78. The rotating belts will pull bags 76 and 78 from pins 72 on curved plate 74 and move the bag through slot 76 until the bag engages lever 95*d* on a limit switch to de-actuate motor 90*a*.

When the piston of cylinder 85*a* is extended bag transfer mechanism 85 is moved from the dashed outline position, carrying the bag toward the full outline position until arm 29 engages a limit switch 29*a* that opens control valves delivering air to cylinder 85*a*. When arm 29 engages switch 29*a* bag transfer mechanism 85 will stop in a home position.

Pinch belts 95 and 96 position the bag adjacent the entrance between pinch belts of a bag tying device of the type disclosed in U.S. application Ser. No. 08/583,567 filed Jan. 5, 1996 entitled "BAG NECK GATHERING STOP," the disclosure of which is incorporated herein by reference in its entirety for all purposes.

Referring to FIG. 11 of the drawing, a tortilla filling apparatus is generally designated by the numeral 100 and comprises a hollow pedestal 102 having a shaft 104 mounted therein with a carousel 120 mounted on the upper end thereof.

A one-way bearing 105 having a lever arm 106 mounted thereon is secured to shaft 104. A pressure actuated cylinder 108 having a piston rod 108*a* mounted on the end thereof is pivotally connected to lever 106 for rotating carousel 120. When the rod 108*a* of cylinder 108 is extended lever 106 and one-way bearing 105 will rotate shaft 104, for example through an angle of 60° or one-sixth of one revolution, if the carousel is provided with six staging stations 122.

A cam 110 is mounted on the lower end of shaft 104 and has a shape similar to a gear with six teeth and six recesses between the teeth.

Figure 12:
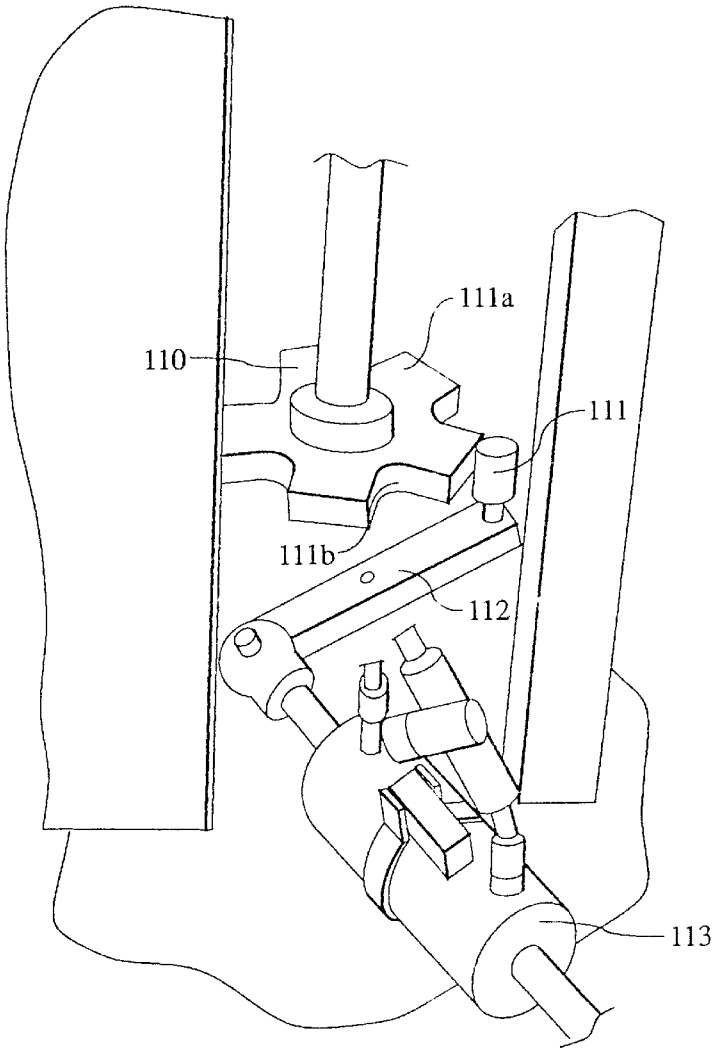
FIG. 12 is a fragmentary elevational view of a cam brake positioned when the carousel is between staging stations.
Figure 13:
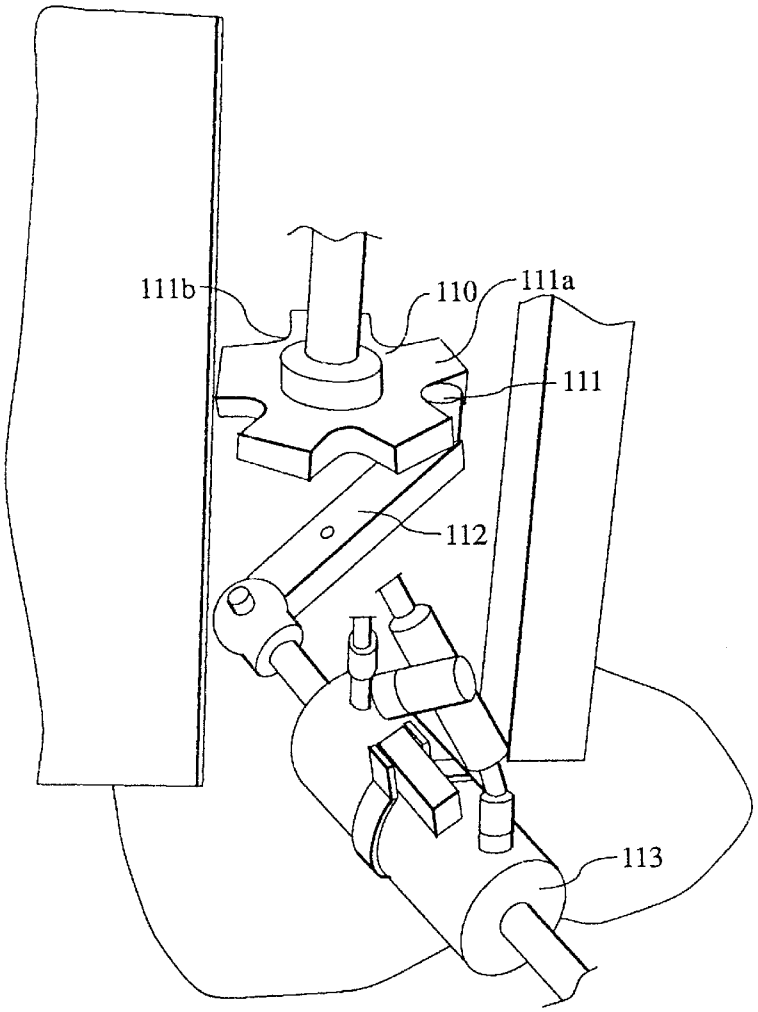
FIG. 13 is an elevational view similar to FIG. 12, the cam brake being positioned to lock the carousel in position for filling a bag.

Referring to FIGS. 12 and 13 of the drawing, an air cylinder 113 has a piston rod that rotates an arm 112 carrying a cam follower 111 to rotate about a vertical axis. When one of the staging stations 122 is properly positioned, cam follower 111 will drop into the space between teeth on cam plate 110 to assure that each staging station 122 is properly positioned relative to the bagging assembly 120. After a stack of tortillas has been deposited into the bagging assembly, air cylinder 113 will be actuated for moving follower 111 out of the notch in the cam plate 110 so that shaft 104 can be rotated by air cylinder 108 through one-way clutch 105 as hereinbefore described.

A brake 115 is mounted on shaft 104 to assure smooth acceleration and de-acceleration of carousel 120. In the illustrated embodiment brake 115 comprises a pulley secured to shaft 104 and a segment of a belt having one end anchored to a post 115*a* and the other end anchored to a post 115*b* such that belt 115*c* extending around the pulley will exert frictional force to aid in stopping rotation of carousel 120 when it has moved to a predetermined position.

In the embodiment of the invention illustrated in the drawing, carousel 120 has six cut-outs 124 to form six staging stations 122. A trap door 125 pivotally mounted on a shaft 126 is rotatable about the vertical axis of shaft 126 from a closed position illustrated in FIG. 12 to an open position illustrated in FIG. 13. An arm 127 is secured to shaft 126 and is urged by a spring 128 having one end secured to the end of arm 127 and another end secured to carousel 120. Spring 128 urges trap door 125 toward the closed position of FIG. 12.

Figure 14:
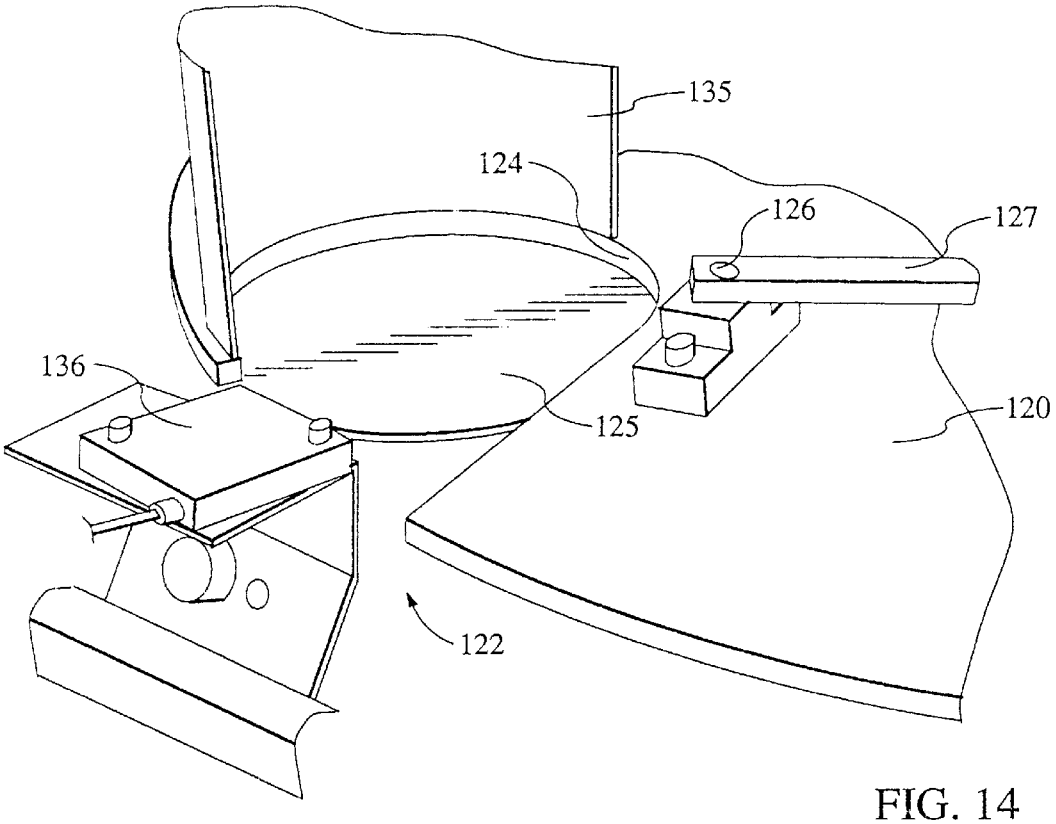
FIG. 14 is an elevational view illustrating a trap door in a closed position.

As best illustrated in FIG. 14, a lug 129 on trap door 125 is spaced from shaft 126. An air cylinder 130 having a piston rod 131 and a generally semicircular end 131 is positioned to engage lug 129 when piston rod 131 is extended for rotating trap door 125 about the axis of shaft 126 for moving the trap door 125 out from under the opening 124 formed in carousel 120. When the trap door 125 is retracted a stack of tortillas or other products will move into engagement with a generally semicircular stacking guide 135 adjacent openings 124 allowing the stack of tortillas to drop through opening 124.

Figure 15:
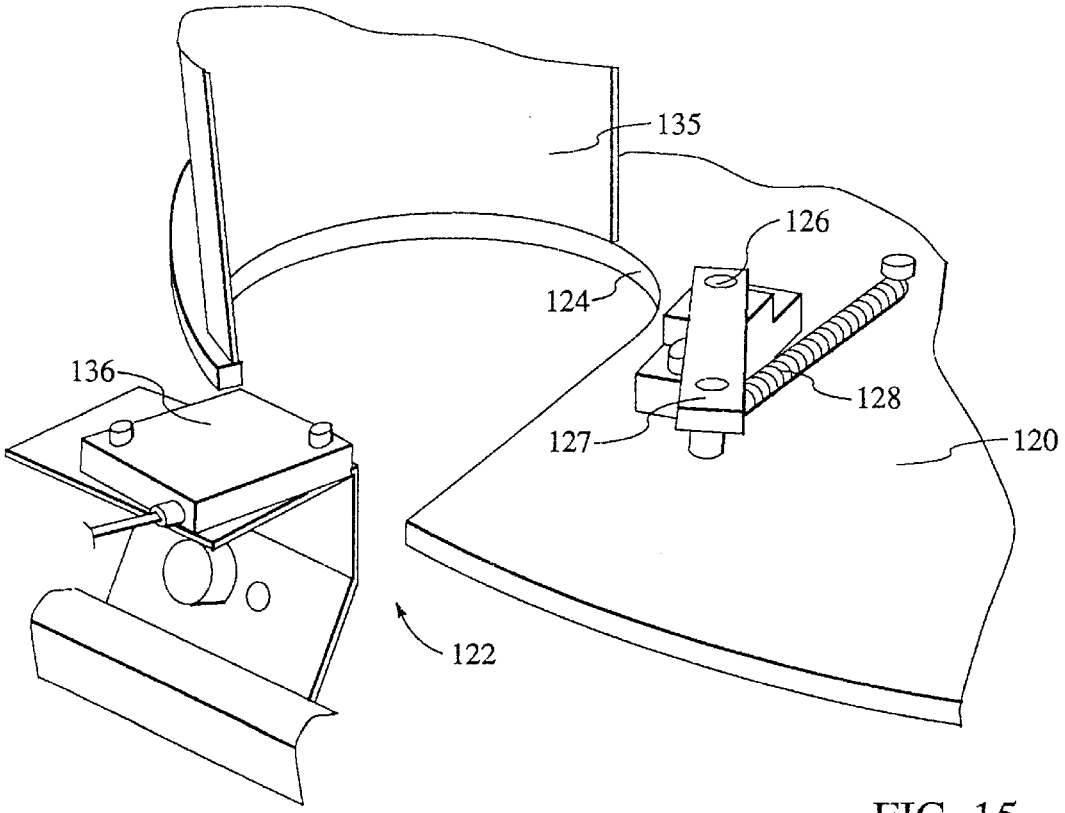
FIG. 15 is an elevational view similar to FIG. 14, the trap door being rotated to an open position.
Figure 16:
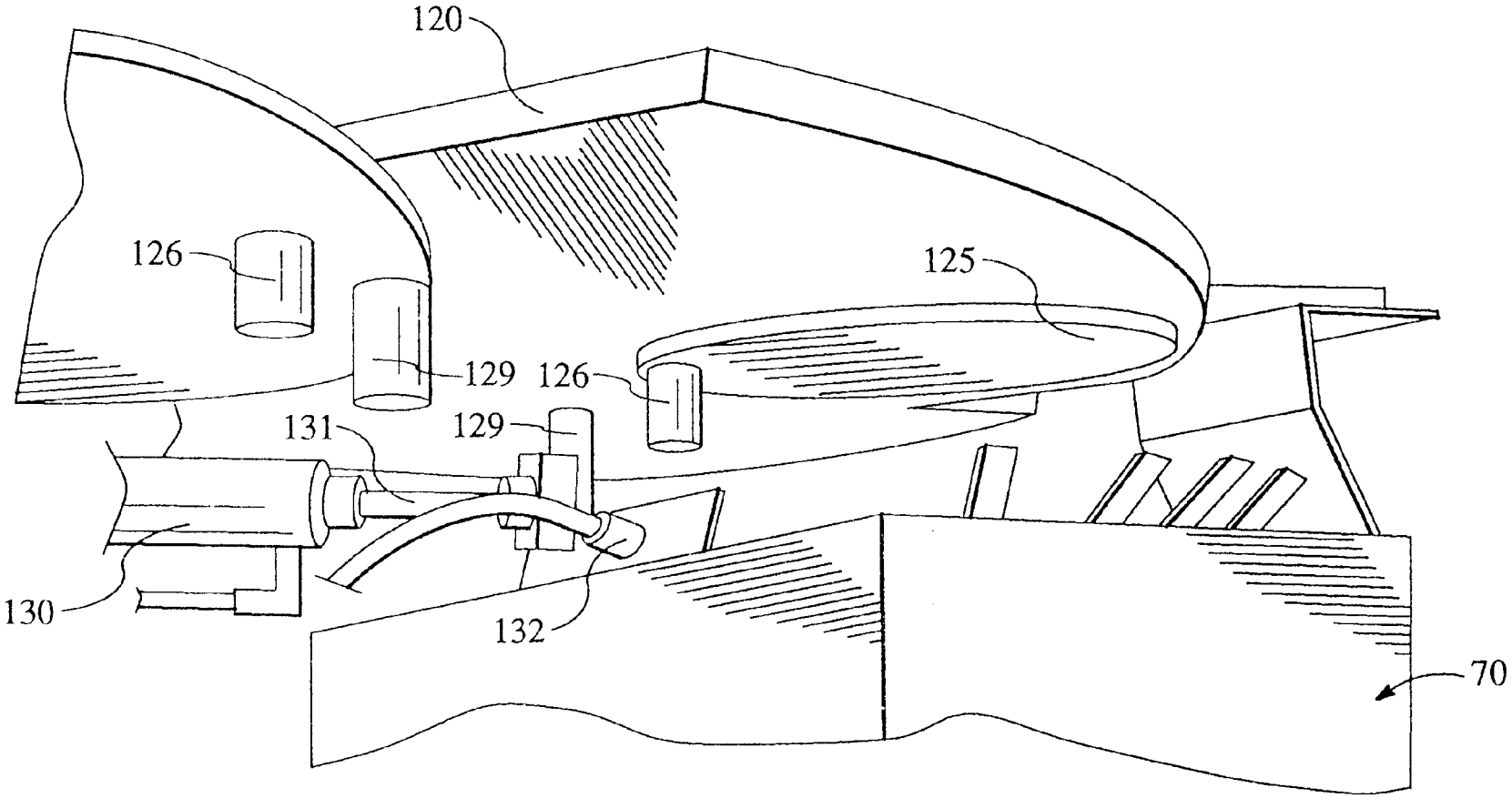
FIG. 16 is a perspective view looking up under the carousel showing a trap door in a closed position.
Figure 17:
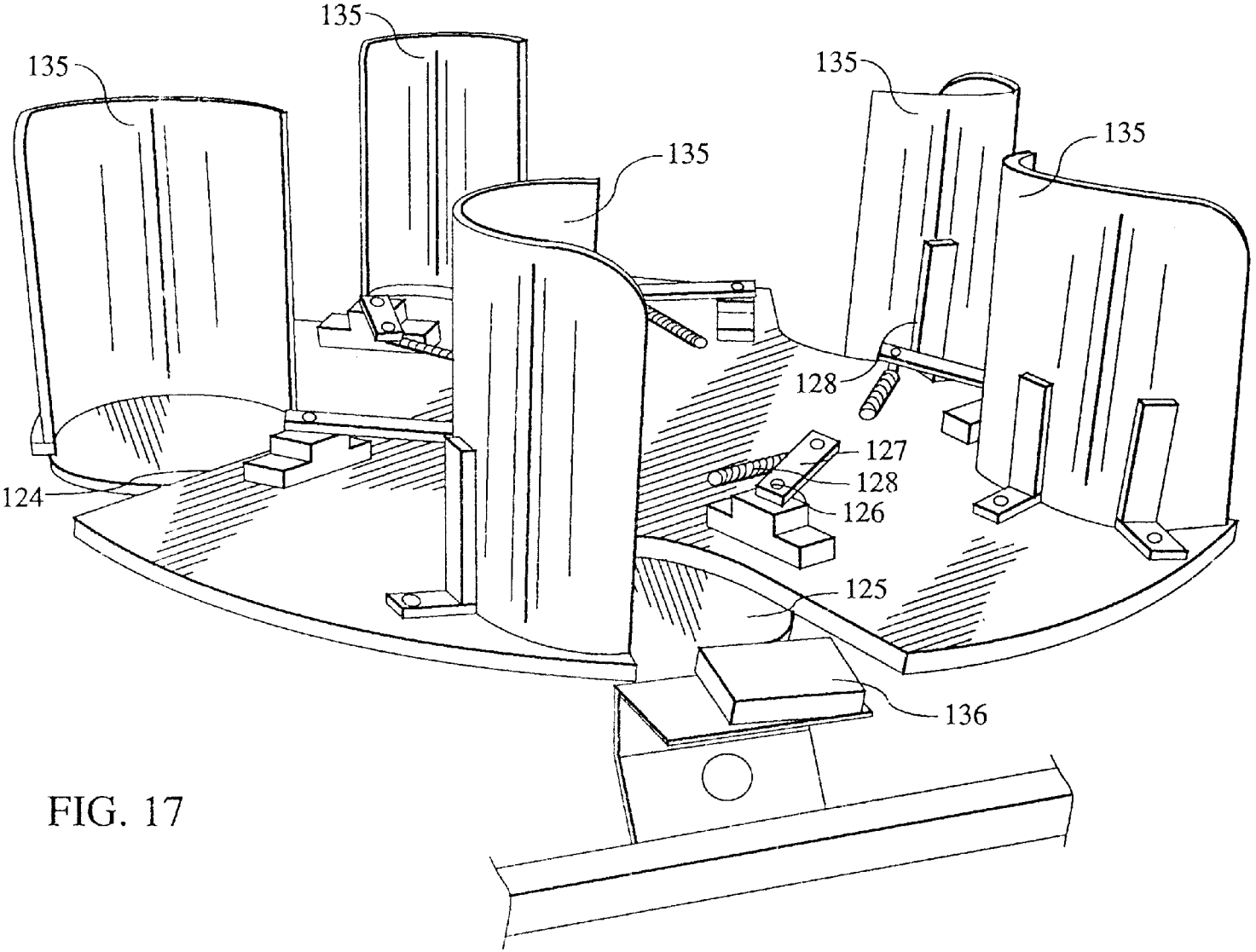
FIG. 17 is a perspective view of a portion of the carousel illustrating a staging station.

Each staging station 125 is out of substantially identical construction and a single air cylinder 130 actuates the various trap doors 125 as carousel 120 rotates to a position wherein lug 129 is positioned adjacent the end 132 of cylinder 130. As the rod 131 of cylinder 130 extends, the trap door 125 rotates about shaft 126 to the retracted position illustrated in FIG. 13. When the rod 131 of cylinder 130 is retracted, spring 128 applies force through lever arm 127 for rotating shaft 126 and trap door 125 back to the closed position illustrated in FIG. 12. A sensor 136 is positioned adjacent bagger 70 to prevent the opening of trap door 125 if a product is not present on trap door 125 at the particular staging station. In the embodiment of the invention illustrated in FIG. 15 sensor 136 sends out a signal which must engage a solid surface and be reflected back to sensor 136, indicating the presence of a stack of product on trap door 125 before the controller will actuate cylinder 130 for opening trap door 125.

An elevator plate 140 is positioned on the end of an air cylinder below bagger 70. When the elevator air cylinder is actuated, the plate will move vertically upwardly to engage the bottom of a bag supported between horns 76 and 78 of the bagger for turning the bag inside out and positioning the bottom of the bag below trap door 125. As trap door 125 moves to the open position the stack of tortillas will drop onto the inverted bag and be supported by the plunger. When the rod supporting the plunger is retracted the tortillas will move downwardly through space between horns 76 and 78. At this point in the cycle of operation bag transfer mechanism 85 will move toward bagger 70 for engaging the neck of the bag by pinch belts 95 and 96. When the rod of cylinder 85*a* is extended bag transfer mechanism 85 will move away from bagger 70 carrying the filled bag to a position adjacent the inlet of the tying station 140.

1996 Vertical Bagger With Servo Tyer

1. Wicket holder for holding customer supplier bags. Bags are specified by Burford with special features:
   a. Wicket holes with tear away notches
   b. Dimensions of bag based on special formula for width, height.
2. Bag opening air feature with air amplifier to pop and hold bag open.
3. Bag holding feature with rotating horns and air sensor to detect when bag is present and bag is held open properly. Small amount of air is allowed to pass through hole in horns. When bag is presented and held properly, the air is restricted by the bag and a air pressure change is detected. The horn is then locked in the holding position until the bag is removed.
4. Product is dropped into the bag.
5. Product is detected with a optical sensor.
6. Transfer device is moved towards the open bag with product in the bag. Transfer device gathers the bag neck and transfers the bag to the servo tyer. The transfer device has the following features:
   a. Two rotating pinch belts driven by variable speed DC motor.
   b. Limit switch to detect when a bag is captured in the transfer device.
   c. Air cylinder to move the transfer device towards the bag holder and back to the servo tyer.
   d. Proximity switch to detect the home position. (Home position is against the servo tyer.)
7. Bag with product is supported and transfer with a flat conveyor through the transfer region and through the servo tyer region and out of the vertical bagger.

8. Servo tyer is used in the vertical application. The following modifications are required in the vertical application:
   a. Relocate ribbon holder and tension assembly
   b. Modify lower guards to remove horizontal bag guide.
   c. Modify pinch belt opening.
   d. Add pivot bracket for access.
9. Electrical enclosure with Programmable Logic Controller (PLC). PLC program and electrical circuit provide the following timing and control functions:
   a. Air flow for opening bag
   b. Air flow for rotating bag horns
   c. Air flow for bag open sensor
   d. Air flow for transfer motion
10. Frame with locking casters. Frame is designed with flat stainless steel sheet for reduced weight and cost. Frame stiffness is maintained with torsion bar welded under lower cross member.

Tortilla Bagger Option

1. Loading carrousel that rotates stacks of tortillas to the vertical bagger. Carrousel has the following features:
   a. Rotation by air cylinder and lever with one way bearing.
   b. Rotation brake for smooth rotation
   c. Position locking cam with air cylinder controlled lock.
   d. Trap doors with air cylinder actuator for dropping of tortillas.
   e. Tortilla stacking guides to support stacks.
   f. Optical sensor to detect tortillas are present.
2. Bag inverting assembly. Bag invertor plate and air cylinder lift has the following functions:
   a. Invert bag after bag opening and holding.
   b. Support weight of tortilla stack when carrousel trap door opens.
   C. Lower tortillas into bag.
3. Additions to electric enclosure and PLC program. The PLC program for the tortilla option is the following modifications to the vertical bagger program:
   a. Control of bag invertor\after opening and holding of the bag.
   b. Control of the bag invertor to lower tortillas into bag.
   c. Rotation of carousel until tortilias are located over vertical bagger.
   d. Control of opening and closing of trap door.

BURF-17,312
BURFORD VERTICAL BAGGER MODEL 1996
TORTILLA BAGGER PROGRAM
FOR OMRON CONTROLLER
VERSION 1, EFFECTIVE BEGINNING 9-24-96

| INPUTS | OUTPUTS |
|---|---|
| 1. PS1 (bag sensor pressure switch) | 1. Air blast SOL2 |
| 2. Product sensor (PSC1) | 2. Horn valve SOL3 |
| 3. Horne sensor (PRS1) | 3. Transfer valve SOL4 |
| 4. Transfer switch (LS1) | 4. Transfer motor enable |
| 5. Tyer ready signal (#59) | 5. Lift valve SOL5 |
| 6. Cycle transfer (PB3) | 6. Indexing valve SOL6 |
| 7. Lift down sensor (INTLK1) | 7. Open door valve SOL7 |
| 8. Lock cylinder sensor (PRS2) | 8. Detent valve SOL8 |

-continued

BURF-17,312
BURFORD VERTICAL BAGGER MODEL 1996
TORTILLA BAGGER PROGRAM
FOR OMRON CONTROLLER
VERSION 1, EFFECTIVE BEGINNING 9-24-96

| INPUTS | | OUTPUTS |
|---|---|---|
| STEP | CODE | EXPLANATION |
| 00 | $\overline{00}$5 | If the tyer is ready |
| 01 | $\overline{00}$3 | and the transfer is home |
| 02 | ⊣□1.00 | wait 1 second then |
| 03 | OUT04 ⊣ | latch the belts enable output on. |
| 04 | $\overline{00}$5 | If the tyer is ready and |
| 05 | $\overline{00}$3 | the transfer is home |
| 06 | $\overline{00}$1L | and the bag sensor is not on |
| 07 | OUT01 ⊣ | latch the air blast on and latch |
| 08 | OUT09 ⊣ | the internal output 9 on. (9 is the bag not present flag). |
| 09 | OI09 ⊣ | When the internal output 9 comes on, |
| 10 | ⊥□1.25 | turn the internal output 14 on for |
| 11 | OUT14 | & time period (horn up time). |
| 12 | OI14 ⊣ | When the internal output 14 goes |
| 13 | OUT02 ⊣ | off latch the horn valve |
| 14 | $\overline{00}$5 | If the tyer is ready and |
| 15 | OI02 | the horn valve is on and |
| 16 | $\overline{00}$1 | the pressure switch is |
| 17 | OUT10 | turn the internal output 10 on. (10 is the bag present fla |
| 18 | $\overline{00}$1 ⊣ | When the bag sensor goes off |
| 19 | OUT09 ⊣ | latch the internal output 9 and |
| 20 | OUT10 ⊣ | the internal output 10 off. (This resets the flags). |
| 21 | OI10 ⊣ | When the internal output 10 comes |
| 22 | OUT09 ⊣L | on, latch the internal output 9 off. |
| 23 | 0102 | If the horn is on and the |
| 24 | $\overline{00}$L | pressure switch is not on |
| 25 | ⊥□0.75 | turn output 13 on for a |
| 26 | OUT13 | period of time. (Horn down time). |
| 27 | OI13 ⊣ | When the internal output 13 goes off |
| 28 | OI10 L | and no bag has been caught latch |
| 29 | OUT02 ⊣ | the horn valve off and |
| 30 | OUT09 ⊣ | latch the internal output 9 off. |
| 27 | $\overline{00}$3 | If the transfer is home and a |
| 32 | OI10 | bag has been caught and |
| 33 | 0107L | the door open valve is not on |
| 34 | OUT05 ⊣ | latch the lift valve on. |
| 35 | OI16L | If the internal output 16 (indexing flag) |
| 36 | OI15L | is not on and the internal output 15(product |
| 37 | OI05 | present flag) is not on and the lift valve |
| 38 | OI07L | is on and the door valve is not on, |
| 39 | ⊣□1.00 | wait for a time period and latch |
| 40 | OUT01 ⊣ | the air blast off and latch |
| 41 | OUT08 ⊣ | the detent lock valve on. |
| 42 | $\overline{00}$6 ⊣ | When the lock cylinder sensor |
| 43 | OUT06 ⊣ | goes off, latch the indexing valve on. |
| 44 | OI06 | If the indexing valve is on wait for |
| 45 | ⊣□0.35 | a time period then latch the |
| 46 | OUT08 ⊣ | detent lock valve off. |
| 47 | $\overline{00}$8 ⊣ | When the lock cylinder sensor |
| 48 | OUTO6 ⊣ | comes on latch the index valve off. |
| 49 | $\overline{00}$8 ⊣ | When the lock cylinder sensor comes |
| 50 | ⊥□0.30 | on turn the internal output 16 |
| 51 | OUT16 | (indexing flag) on for a time period. |
| 52 | OI16L | If the internal output 16 (indexing |
| 53 | OI10 | flag) is not on and the internal output 10 |
| 54 | $\overline{00}$2 | is on and the product sensor is on and |
| 55 | $\overline{00}$3 | the transfer is home wait for |
| 56 | ⊣□0.60 | a time period then latch the |
| 57 | OUT15 ⊣ | internal output 15 (product present) on. |
| 58 | OI15 | If the internal output 15 is on |
| 59 | OUT07 | open the drop door. |
| 60 | OI07 | When the drop door opens wait |
| 61 | ⊣□0.50 | for a time period then latch |
| 62 | OUT05 ⊣ | the lift valve off. |
| 63 | OI15 | If the internal output 15 is on (product |
| 64 | $\overline{00}$7 | present) and the lift is down, latch |

-continued

BURF-17,312
BURFORD VERTICAL BAGGER MODEL 1996
TORTILLA BAGGER PROGRAM
FOR OMRON CONTROLLER
VERSION 1, EFFECTIVE BEGINNING 9-24-96

| INPUTS | OUTPUTS |
|---|---|
| OUT03 ↑ | the transfer valve on and latch |
| OUT07 ↓ | the door open valve off. |
| 007 | If the transfer is down and |
| 004 ↓ | the transfer limit switch comes |
| OUT03 ↓ | on latch the transfer valve off and latch the |
| OUT15 ↓ | internal output 15 off. (This resets the product flag). |
| 003 ↓ | When the transfer home prox. goes off |
| 005 | and the tyer is ready, latch |
| OUT02 ↓ | the horn valve off and latch |
| OUT15 ↓ | the internal output 15 off. |
| 004 ↑ | When the transfer limit switch comes |
| 003L | on and the transfer is not home |
| OUT12 ↑ | latch the internal output 12 (transfer not home flag) on. |
| OI12 ↑ | if the internal output 12 comes on |
| CUT04 ↓ | latch the belt motor enable off. |
| 003 ↑ | When the transfer home prox. comes |
| 005 | on and the tyer is ready and |
| 0I12 | the internal output 12 is on |
| OUT04 ↑ | Latch the belt motor enable on. |
| 003 ↑ | When the transfer home prox. comes |
| OUT12 ↓ | on latch the internal output 12 off (this resets the flag). |
| 006 ↑ | When the transfer cycle pushbutton |
| 005 | comes on and the tyer is ready |
| 007 | and the lift is down turn |
| ⏱2.00 | the transfer valve on for |
| OUT03 | a time period. |
| 005 ↓ | When the tyer is not ready |
| OUT04 ↓ | latch the belts off. Latch |
| OI10 ↓ | the internal output 10 off, and latch |
| OUT05 ↓ | the lift off. |

Having described the invention, we claim:

1. A vertical bagger comprising:

a frame;

a bagger assembly on one end of the frame;

a tyer assembly on the other end of the frame;

a carriage movable longitudinally of the frame between the bagger assembly and the tyer assembly, said carriage having spaced pinch belts movable into engagement with the outer surface of the bag;

a guide bar extending longitudinally of the frame;

means for reciprocating said carriage longitudinally of said guide bar for moving bags engaged by said pinch belts from said bagger assembly to said tyer assembly; and means for moving said pinch belts on said carriage for removing a bag from said bagger assembly when the carriage is adjacent the bagger assembly and to position the bag adjacent the tyer assembly when the carriage is adjacent the tyer assembly.

2. A vertical bagger according to claim 1 with the addition of:

a conveyor on said frame below said carriage, said conveyor supporting the bottom of a bag while the neck of a bag is engaged by said carriage.

3. A vertical bagger according to claim 1, said carriage comprising:

a pinch belt assembly for moving the neck of a bag from said bagger assembly such that movement of said carriage longitudinally of said guide bar causes the neck of the bag to be gripped such that it moves with the carriage longitudinally of the guide bar.

4. A vertical bagger according to claim 1 with the addition of:

a plurality of pulleys on said carriage for moving said pinch belts relative to said carriage.

5. A vertical bagger according to claim 1 with the addition of:

two parallel upper ledges mounted on said frame, one said ledge having a groove formed therein and wherein said guide bar is mounted on the other ledge;

a guide arm mounted on said carriage; and a sleeve mounted on said carriage opposite said guide arm, said guide arm being engaged in said groove and said sleeve engaging said guide bar.

6. A vertical bagger according to claim 5 wherein said actuator comprises:

a pressure actuated air cylinder and piston assembly with first and second ends, said first end mounted on said frame and said second end mounted on said carriage, wherein said cylinder and piston assembly, when extended and retracted reciprocates said carriage.

7. A vertical bagger comprising:

an apparatus frame;

a bagger assembly on one end of the apparatus frame;

a wicket mounted on said apparatus frame, said wicket having a curved plate with a first and second side and having two pins for suspending bags extending from said first side of said plate;

an air jet for opening a bag mounted on said apparatus frame, said air jet positioned to deliver air onto the second side of said plate;

a horn assembly having a first and second opposed horn spaced apart and having a length between said horns for rotating said horns in opposite directions from an upper position to a lower position, in which said lower position the horns engage the inner surfaces of the bag;

a tyer assembly on the other end of the apparatus frame;

a bag transfer mechanism movable longitudinally of the apparatus frame between the bagger assembly and the tyer assembly;

a guide bar extending longitudinally of the apparatus frame; and means for reciprocating said bag transfer mechanism longitudinally of said guide bar for moving bags from said bagger assembly to said tyer assembly.

8. A vertical bagger according to claim 7 further comprising:

a first air valve system having an air valve mounted on the apparatus frame and connected to a hose and a source of pressurized air;

an air pressure sensor disposed in the air valve system for detecting changes in air pressure within the air valve system;

a passage extending through said first horn, wherein said passage, when said first horn is in said lower position, is positioned adjacent said air valve.

9. A vertical bagger according to claim 8, further comprising:

a second air valve system substantially identical to the first;

a passage through said second horn wherein said passage in the second horn is positioned adjacent said second air valve system when said second horn is in said lower position.

10. A vertical bagger according to claim 7, wherein:

said set of pinch belts consists of a first and second belt each extending around a drive pulley, a tension adjustment pulley and idler pulleys;

said first and second belts having a common length wherein said belts are adjacent and driven by a belt drive motor in a common direction;

and wherein two of said pulleys on said first belt and two of said pulleys on said second belt are arranged to generally form a V-shaped entrance area to the common length;

and further comprising a limit switch having a lever, said lever positioned across said common length of said pinch belts, said lever for deactivating said belt drive motor when a bag engages said lever.

11. A vertical bagger according to claim 7, further comprising:

a shaft having a lower and upper end, a carousel mounted on the upper end, a cam mounted on the lower end, said cam having multiple teeth with recesses therebetween;

a rotator for said carousel;

a cam follower having a first position in engagement with said recesses of said cam and a second position in disengagement with said recesses;

said carousel having multiple staging stations for deployment of a product, each said staging station defined by a hole extending through the carousel;

a trap door mounted pivotally on a hinge having a vertical axis beneath each staging station, each said trap door having an open and closed position.

12. A vertical bagger according to claim 11, wherein said rotator comprises:

a one-way bearing having a lever arm mounted thereon secured to said shaft;

a pressure actuated cylinder and piston assembly having a first and second ends, said first end pivotally connected to said lever arm and said second end pivotally mounted on said apparatus frame.

13. A bag filling and closing apparatus as in claim 11, further comprising:

a pressure actuated cylinder and piston assembly having a first and second ends, said first end pivotally connected to the first end of an arm, the second end of said arm mounted to said cam follower, said cylinder and piston assembly for rotating said cam follower on a vertical axis between a first positions.

14. A vertical bagger according to claim 11, further comprising:

a door arm extending from each said door, said door arm attached to one end of a spring, said spring attached at the opposite end to the carousel, said spring urging said door to the closed position;

a pressure actuated cylinder and piston assembly having a first and second ends, said first end attached fixedly with respect to said carousel, said second end positioned to engage said doors to rotate said doors between the open and closed positions.

15. A vertical bagger according to claim 11, further comprising:

an elevating assembly positioned below said horns having a plunger mounted at one end of a shaft, said shaft attached at the opposite end to a pressure actuated cylinder and piston assembly for inverting a bag by moving said plunger vertically upward between said horns.

16. A vertical bagger comprising:

a frame;

a bagger assembly on one end of the frame;

a turntable having a plurality of openings adjacent said bagger assembly;

means for rotating said turntable for sequentially positioning said openings adjacent said bagger assembly;

a plurality of trap doors movably secured to said turntable for closing said openings;

an actuator associated with said turntable for moving each of said trap doors between a first position below one of said openings and a second position to permit a stack of objects supported by one of the trap doors to fall through one of said openings into a bag supported by said bagger assembly;

a tyer assembly on the other end of the frame;

a bag transfer mechanism movable longitudinally of the frame between the bagger assembly and the tyer assembly;

a guide bar extending longitudinally of the frame; and means for reciprocating said bag transfer mechanism longitudinally of said guide bar for moving bags from said bagger assembly to said tyer assembly.

17. A vertical bagger comprising:

an apparatus frame;

a bagger assembly on one end of the apparatus frame;

a tyer assembly on the other end of the apparatus frame;

a bag transfer mechanism movable longitudinally of the apparatus frame between the bagger assembly and the tyer assembly;

a guide bar extending longitudinally of the apparatus frame;

means for reciprocating said bag transfer mechanism longitudinally of said guide bar for moving bags from said bagger assembly to said tyer assembly;

a carriage frame having a first and second vertical hollow post spaced apart from one another, each post having a front and rear face, said carriage frame mounted on said apparatus frame;

a first carriage device having two spaced plates extending on opposite sides of said first post, and having a plurality of rollers rotatably mounted between said spaced plates which engage said front and rear faces of said first post;

said carriage device further having a channel member which extends longitudinally of said spaced plates having lugs for supporting said conveyor assembly;

said carriage device further having a threaded nut mounted between said spaced plates and having a threaded shaft extending vertically therefrom through said first hollow post, said threaded shaft having a sprocket, and a second carriage device, substantially identical to the first and mounted on said second hollow post, and further having a hand wheel mounted on said sprocket;

said sprockets connected by a chain such that rotation of said hand wheel rotates said threaded shafts in unison for moving first and second carriage assemblies vertically along said first and second posts.

* * * * *